United States Patent [19]

Decuq et al.

[11] 4,451,006

[45] May 29, 1984

[54] PACKAGE-LIFTING SYSTEM IN AN UNWINDING OR TWISTING MACHINE

[75] Inventors: Guy Decuq; Anne Mouterde, both of Lyons, France

[73] Assignee: Verdol S.A., Caluire, France

[21] Appl. No.: 482,697

[22] Filed: Apr. 6, 1983

[30] Foreign Application Priority Data

Apr. 7, 1982 [FR] France ..... 82 06538

[51] Int. Cl.[3] ..... B65H 54/42

[52] U.S. Cl. ..... 242/18 DD

[58] Field of Search ..... 242/18 DD, 65, 66

[56] References Cited

U.S. PATENT DOCUMENTS

| | | | |
|---|---|---|---|
| 2,752,100 | 6/1956 | Stange | 242/18 DD |
| 3,008,658 | 11/1961 | Akers | 242/18 DD |
| 3,009,661 | 11/1961 | Akers | 242/18 DD |
| 3,430,875 | 3/1969 | Kieronski | 242/18 DD |
| 3,516,614 | 6/1970 | Bauer et al. | 242/18 DD |
| 3,552,666 | 1/1971 | Stenmans et al. | 242/18 DD |

*Primary Examiner*—Stanley N. Gilreath

*Attorney, Agent, or Firm*—Dowell & Dowell

[57] ABSTRACT

The present invention relates to a package-lifting system in an unwinding or twisting machine, which comprises two wheels around which is tensioned a metal ribbon fixed to the periphery of each wheel. The first wheel is angularly fastened to a first fixed shaft, while the second wheel, which is connected a stirrup between the arms of which a package is placed, is mounted to rotate freely on a second shaft. The latter shaft is borne by one of the ends of an arm of which the other end is articulated about the first shaft. The invention is particularly applicable to the textile industry.

7 Claims, 3 Drawing Figures

PACKAGE-LIFTING SYSTEM IN AN UNWINDING OR TWISTING MACHINE

The present invention relates to a package-lifting system in an unwinding or twisting machine.

It is known that, in an unwinding or twisting machine, the yarn is stored on the core of a package driven in rotation by friction by means of a drive drum. As the yarn is deposited on the package, the diameter of said package increases, with the result that it is necessary to guide the package being formed and to maintain it in position.

Several solutions have already been proposed for these operations.

Slides have firstly been provided, in which the spindle of the core of the package moves in order to ensure guiding thereof.

It has also been known to mount the core of the package at the end of a pivoting arm so that the package moves in an arc of a circle.

Finally, with a view to clearing the rear part of the package being formed, a parallelogram system is generally used as a package guiding and holding means.

Each of these various embodiments has drawbacks and, in particular, they do not enable as assembly to be produced which is sufficiently rigid to avoid vibrations. In addition, the arcuate path followed is not ideal as, when the package becomes larger, it tends to be crushed and to abut on the yarn guide because the guide is disposed as near as possible to the package being formed. Its periphery then comes into contact with the yarn guide, so that it is necessary to push it back, this involving an additional operation which increases the cost of the operation.

For these two reasons, it is desirable to choose a path of the package which is somewhat different from an arc of circle.

It is an object of the improvements according to the present invention to obtain this result, the principal advantage of which is that of maintaining the yarn guide in the same position close to the package, for the whole duration of the formation of the package.

The invention will be more readily understood on reading the following description with reference to the accompanying drawings, in which.

Figure 1:
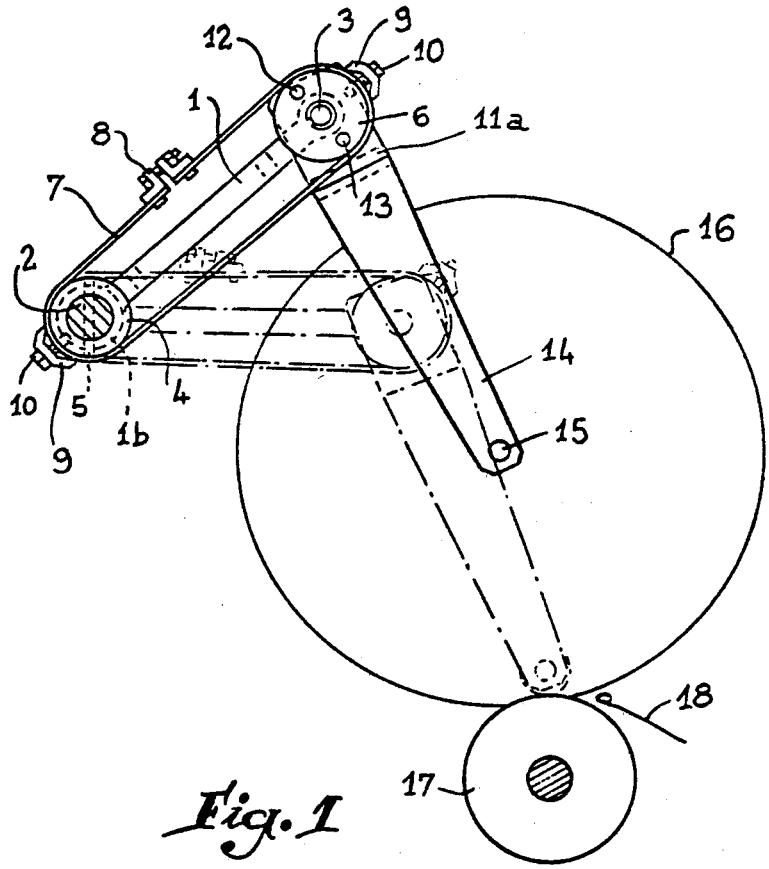
FIG. 1 is a side view of a package-lifting system according to the invention.
Figure 2:
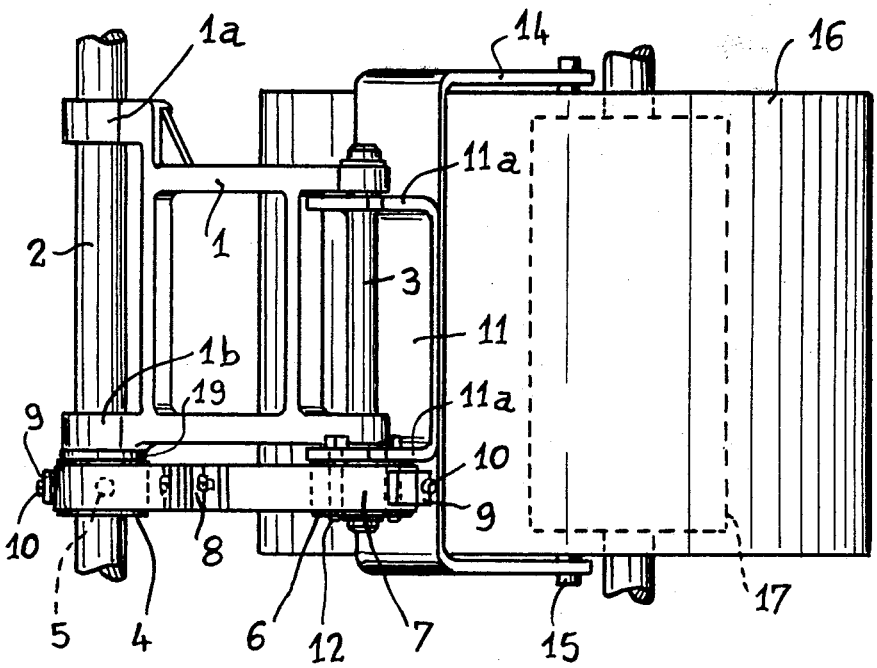
FIG. 2 is a plan view thereof.

Referring now to the drawings, as illustrated in FIGS. 1 and 2, the package-lifting system according to the invention firstly comprises a double arm member 1 articulated freely upon ears 1*a*, 1*b* about a first fixed shaft 2. The ends of the double arm member 1 opposite the ears 1*a*, 1*b* constitute a bearing for a second shaft 3. Adjacent the ear 1*b* of the arm 1 is mounted on shaft 2 a wheel 4 angularly fixed on said shaft due to the presence of a transverse pin 5. The second shaft 3 projects beyond the arm 1 so that a second wheel 6 may be mounted to rotate freely opposite the wheel 4 on the relevant end of shaft 2. A funicular member, advantageously comprising a steel ribbon and generally designated by reference 7, passes around the two wheels 4 and 6. This ribbon, due to the presence of a tension device 8, is strongly tensioned so that it is tightly applied on the periphery of the two wheels 4 and 6. To prevent any slipping from occurring between the ribbon 7 and these wheels, a V-block 9 is used on each of them, in the central part of which is engaged a screw 10 which passes through the ribbon to screw in a threaded hole in each wheel. The ribbon 7 is thus perfectly fastened on the periphery of the wheels.

One of the side 11*a* of a fork joint 11 is fixed to the inner face of the wheel 6 by means of two screws 12 and 13. The fork joint 11 is fixed with a stirrup 14 between the ends of the arms of which are rotatably mounted the two ends of the spindle 15 of the core (not shown) of the yarn package 16.

Also shown are the drive drum 17 adapted to rotate the package 16, as well as the yarn guide 18 located virtually in the horizontal plane passing through the upper generatrix of the drum 17. Between the ear 1*b* of the arm member 1 and the wheel 4 is placed a washer 19 made of a material with a high coefficient of friction, such as that used for drum brake linings and which is intended to brake the pivoting of the arm.

Operation follows from the foregoing explanations.

Figure 3:
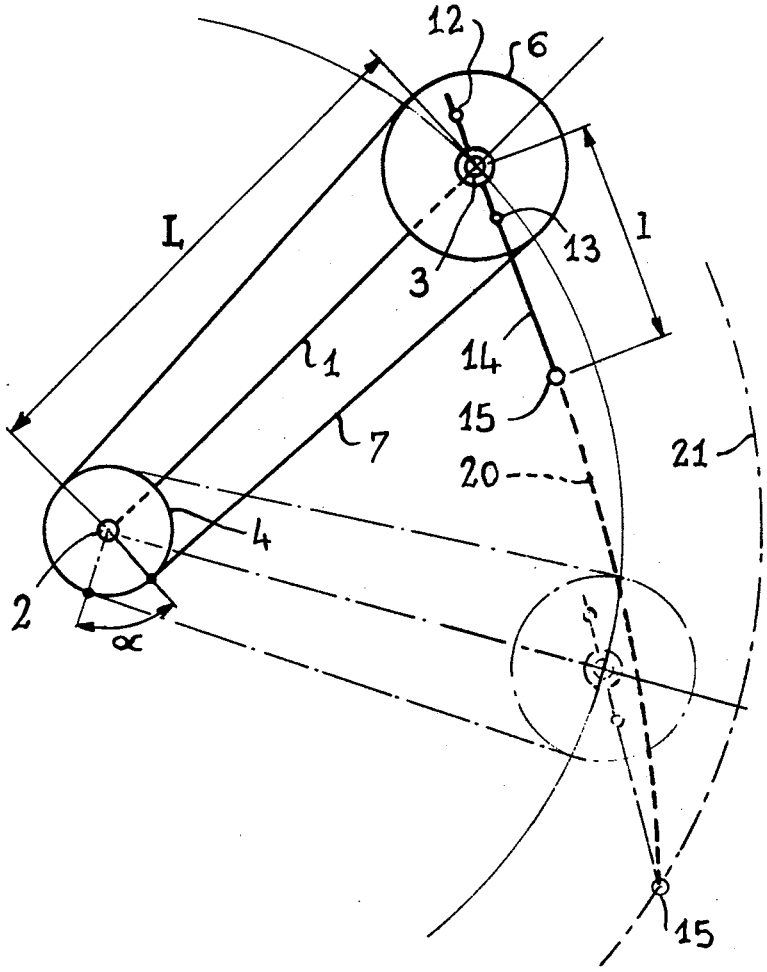
FIG. 3 illustrates the principle of operation of the system according to the invention.

As illustrated in FIGS. 1 and 3, at the beginning of the winding operation, the core of the package 16 rests against the drum 17, which drives said core in rotation. When a yarn leaving the yarn guide 18 is engaged between the core in question and the drum 17, it is wound in superposed layers determined by the reciprocating movement of the yarn guide 18. As the thickness of the layers of yarn increases, i.e. when the diameter of the package 16 grows, the stirrup 14 is pushed upwardly. This rising movement causes wheel 6 to rotate, which leads to a change in relative position of the ribbon 7 supported on the two wheels 4 and 6. The lift of the stirrup 14 causes a winding through an angle $\alpha$ of the ribbon 7 on the periphery of the wheel 4, which can not rotate since it is pinned to the fixed shaft 2, whilst a corresponding length of ribbon unwinds from the periphery of wheel 6. Due to the presence of washer 19, the upward displacement of arm 1 is braked.

The path 20 of the spindle 15 of the core of the package 16 is a curve which is a function of the ratio of the radii of the two wheels 4 and 6 and of lengths L and l of the arm 1 and the stirrup 14 respectively.

It will be observed that, with respect to the circular path 21 which the spindle 15 would follow if it were connected by a lever to the first shaft 2, the actual path 20 of the center of the spindle is located within the machine always to the left of the center of the drive drum 17, so that the full package is in an excellent position to fall by gravity onto a central conveyor belt (not shown), as is well known in the art. It is obvious that the mechanism for maintaining the package elevated with respect to the drive drum 17 at the end of the winding operation has not been described in detail, as this mechanism is quite conventional.

A system has thus been produced for guiding a package in the course of formation, which presents considerable rigidity as all clearances are compensated by the steel ribbon, this leading to excellent resistance of the package. In addition, the system comprises a reduced number of pieces and is therefore much less expensive than those used heretofore.

It must be understood that the foregoing description has been given only by way of example and that it in no way limits the domain of the invention whose scope would not be exceeded by replacing the details of execution described by any other euqivalents. For example, the assembly constituted by the two wheels 4, 6, the ribbon 7 and the arm 1 may be disposed at the centre of the fork joint 11. The latter would then advantageously be fixed to the shaft 3 on which the wheel 6 would be fixed, whilst shaft 3 would pivot freely on the relevant end of the arm 1.

What is claimed is:

1. In a yarn package winding machine of the type including package-lifting means supporting a package core being wound against a drive drum adjacent to a yarn traverse, an improved package-lifting means comprising:

(a) a spindle disposed parallel to the axis of the drive drum for supporting a package core;

(b) a first shaft fixed to the machine and disposed parallel to the spindle;

(c) a first wheel non-rotatably mounted on the first shaft;

(d) an arm member pivotally supported on the first shaft and having bearing means located on the arm member spaced from the first shaft;

(e) a second shaft supported in said bearing means parallel to the spindle;

(f) a second wheel supported on the second shaft and rotatable with respect to the arm member;

(g) a funicular member extending around both wheels and tensioned therebetween, the funicular member being fixed to a point on the periphery of each wheel; and (h) a stirrup having arms extending toward and supporting said spindle, and the stirrup being mounted to rotate with said second wheel, whereby as the package grows in diameter during winding of yarn thereon the stirrup and arm member will pivot away from the drive drum about the first shaft and the funicular member will wind on one side of the first wheel and unwind from one side of the second wheel thereby to decrease the angle between the arm member and the arms of the stirrup.

2. The package-lifting means as claimed in claim 1, wherein the funicular member comprises a metal ribbon provided with a tension device.

3. The package-lifting means as claimed in claim 2, wherein the ribbon is fixed to the periphery of each of said wheels by V-blocks respectively screwed to said peripheries and clamping the ribbon thereagainst.

4. The package-lifting means as claimed in claim 1, wherein the arm has spaced outer ends supporting plural bearing means in mutually spaced relationship.

5. The package-lifting means as claimed in claim 1, wherein a fork is interposed between the stirrup and the second wheel, the fork having two ends pivoted on the second shaft, and one of the ends of the fork being fixed to the second wheel.

6. The package-lifting means as claimed in claim 1, wherein a washer made of high coefficient of friction material is interposed between the first wheel and the arm member, whereby the arm member is frictionally braked when it tries to rotate about the first shaft.

7. The package-lifting means as claimed in claim 1, wherein the second wheel is fixed to the second shaft for unitary rotation therewith, and the stirrup is fixed to the second shaft and rotates therewith.

* * * * *